US007801423B2

(12) United States Patent
Ikesaki

(10) Patent No.: US 7,801,423 B2
(45) Date of Patent: Sep. 21, 2010

(54) HAIR DRIER

(75) Inventor: Roberto Jun Ikesaki, São Paulo (BR)

(73) Assignee: Daihatsu Industria E Comercio De Moveis E Aparelhos Eletricos Ltda (BR)

( * ) Notice: Subject to any disclaimer, the term of this patent is extended or adjusted under 35 U.S.C. 154(b) by 805 days.

(21) Appl. No.: 10/569,776

(22) PCT Filed: Feb. 16, 2004

(86) PCT No.: PCT/BR2004/000010

§ 371 (c)(1),
(2), (4) Date: May 8, 2007

(87) PCT Pub. No.: WO2005/023043

PCT Pub. Date: Mar. 17, 2005

(65) Prior Publication Data

US 2007/0274696 A1 Nov. 29, 2007

(30) Foreign Application Priority Data

Sep. 4, 2003 (BR) ..... 0303784

(51) Int. Cl.
*A47J 27/00* (2006.01)
*A45D 20/12* (2006.01)
*A45D 20/10* (2006.01)

(52) U.S. Cl. ..... 392/380; 34/96; 392/385

(58) Field of Classification Search ..... 392/379–385; 34/282, 283, 101, 96
See application file for complete search history.

(56) References Cited

U.S. PATENT DOCUMENTS 5,448,677 A * 9/1995 Fell et al. ..... 392/383
5,727,331 A * 3/1998 Thaler et al. ..... 34/97
5,805,406 A 9/1998 Mailand (Continued)

FOREIGN PATENT DOCUMENTS

JP 2002065344 5/2002

OTHER PUBLICATIONS

International Search Report; PCT/BR2004/000010; Mar. 11, 2005.

*Primary Examiner*—Daniel Robinson
(74) *Attorney, Agent, or Firm*—Cantor Colburn LLP

(57) ABSTRACT

"IMPROVED HAIR DRIER" including a housing, inside which an electrical engine is mounted, which activates a rotor generating an axial air flow crossing the equipment and contacting the heating element represented by an electrical resistance, duly mounted in a spacing structures; the housing of the relevant hair drier further incorporates a gripping part from which the electrical cable emerges, thereby allowing to connect the equipment with the electrical network, the gripping part further incorporating keys which control independently both the activation of the electrical engine and also the activation of the electrical resistance, the relevant hair drier is characterized for incorporating an ionizing device, which essentially is a high voltage source with a limited current; the ionizing device is connected with the conventional electrical circuit of the equipment, it being activated simultaneously with the activation of the electrical engine, or further at the time of the conjoint activation of both electrical engine and electrical resistance; from the ionizing device, at least one cable emerges, which is duly insulated by a sheath, and at the end of the cable an active pole x is mounted.

7 Claims, 2 Drawing Sheets

U.S. PATENT DOCUMENTS 6,191,930 B1 * 2/2001 Ramchandani ..... 361/213
6,715,215 B1 * 4/2004 Yeung ..... 34/96
6,907,678 B2 * 6/2005 Cruz ..... 34/97

* cited by examiner

HAIR DRIER

TECHNICAL FIELD OF THE INVENTION

The present report describes a hand hair dryer, such as that commonly used in beauty parlors and related establishments, incorporating an improvement which is particularly associated with the incorporation, in said equipment, of a ionizing device producing negative ions.

DESCRIPTION OF THE RELATED ART

As it is known by professionals operating in electrical and/or electronic projects, a high voltage source duly installed can emit a great number of negative ions. It is further known by said professionals that a negative ion generator is essentially similar to an electrostatic generator, which is a device producing high voltage.

Based on this functional principle, air-sterilizing devices were launched in the 70's, incorporating internal ionization devices, which provided ionization of the air passing inside the equipment, thereby producing ambient air sterilization effect.

On the other hand, the electrostatic energy is also generated in a natural manner, for example, when hairs are brushed with combs or brushes manufactured in plastic material.

Under such circumstances, friction between the hair and the comb (or brush) induces the electrical load exchange, causing the hair to be loaded with a positive polarity static electricity.

When loaded with a positive load, hairs usually become ruffle or bristly, in a level proportional to the load applied to the same.

To a certain extent, in some cases the static electricity ends up to damage the quality of coiffure, since hairs, when loaded, are likely not to assume the desired arrangement, such a phenomenon being more frequent in dry days, with a few air humidity.

BRIEF SUMMARY OF THE INVENTION

In view of such a disadvantage, the improved air drier under this invention privilege patent has been developed, which incorporates an ionizing device generating negative ions which are drawn by the air draft crossing the equipment and are directed towards user's hair, causing the same to be negatively ionized.

The ionizing effect produced by the proposed hair drier allows possible positive loads present in hairs (responsible for the bristly effect) and generated, for example, by the use of combs or brushes manufactured in plastic material, to be neutralized by negative ions which are administered to the drying air flow through the ionizing device incorporated to the equipment.

In view of the foregoing, one of the objectives of the present invention privilege patent is providing a hair drier incorporating in its structure, in addition to conventional components, such as electrical resistance, electrical engine, turbine or rotor driven by said electrical engine etc., an ionizing device which, as it allows neutralization of occasional positive static loads present in hairs, through generation of negative ions, it may allow to get a better quality in the execution of coiffures in general.

Another objective of the present invention privilege patent is providing a hair drier with a ionizing device which, due to its technical characteristics, presents a total operating safety on the part of the user.

BRIEF DESCRIPTION OF THE DRAWINGS

The hair drier under the present invention patent will be described in details in drawings listed below, in which.

DETAILED DESCRIPTION OF THE INVENTION

Figure 1:
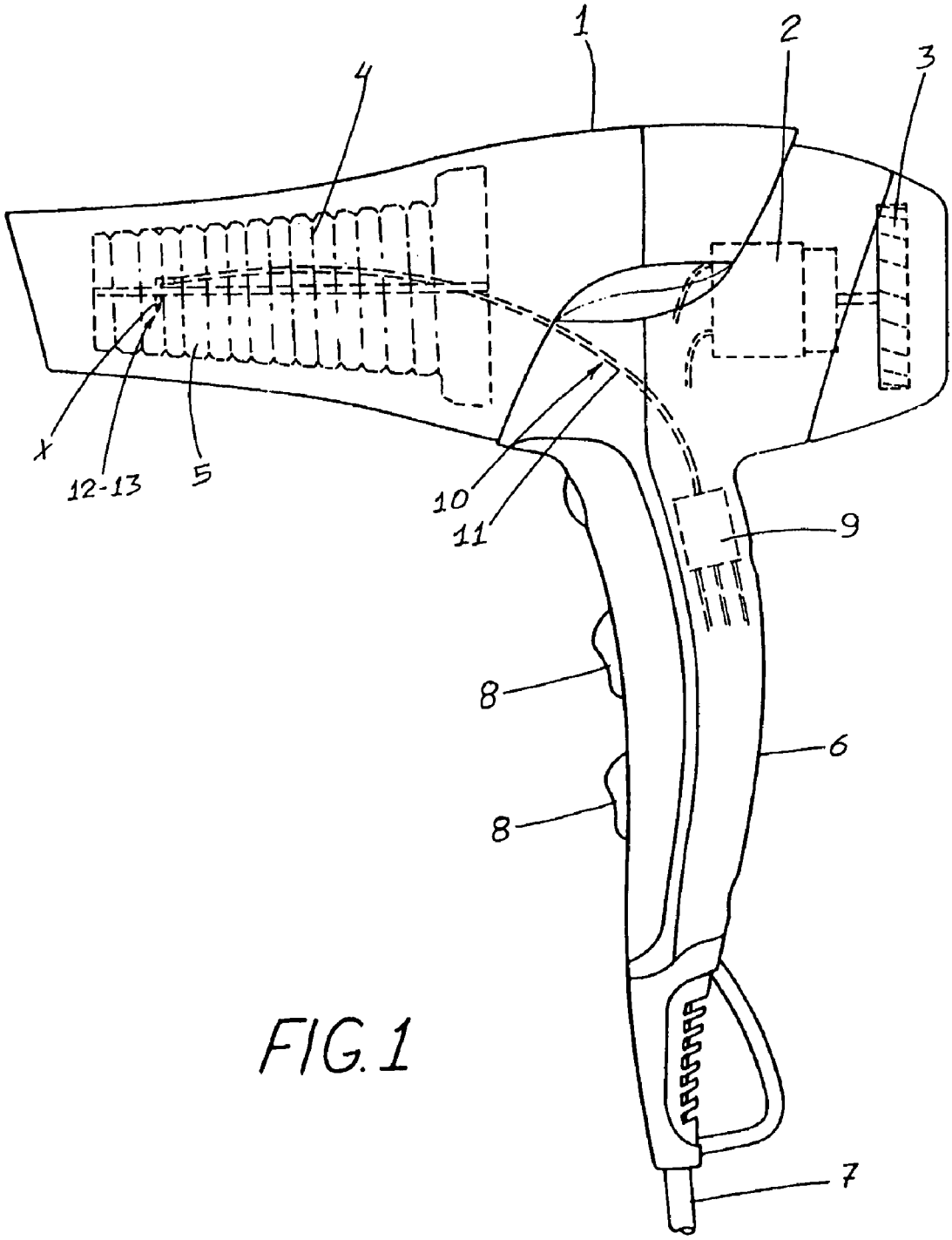
FIG. 1 illustrates a general and schematic view of the relevant hair drier.

According to illustration of above-mentioned figures, the improved hair drier under the present invention privilege patent comprises a housing 1 inside which an electrical engine 2 is mounted, activating a rotor or turbine 3 which generates an axial air flow crossing the device and contacting the heating element represented by an electrical resistance 4, which is duly mounted in a spacing structure 5.

The housing 1 of the relevant hair drier further incorporates a gripping part 6 from which the electrical cable 7 emerges, allowing to connect the device with the electrical network, said gripping part 6 further incorporating keys 8 which individually control both electrical engine 2 activation and electrical resistance 4 activation; the relevant hair drier is characterized for incorporating an ionizing device 9 which essentially is a high voltage source with a limited current.

The ionizing device 9 is connected with the conventional electrical circuit of the equipment, it being activated simultaneously with activation of the electrical engine 2 or further at the conjoint activation of both electrical motor 2 and electrical resistance 4.

The ionizing device 9 is illustrated in a schematic manner, as in itself it is a very known component.

Figure 2:
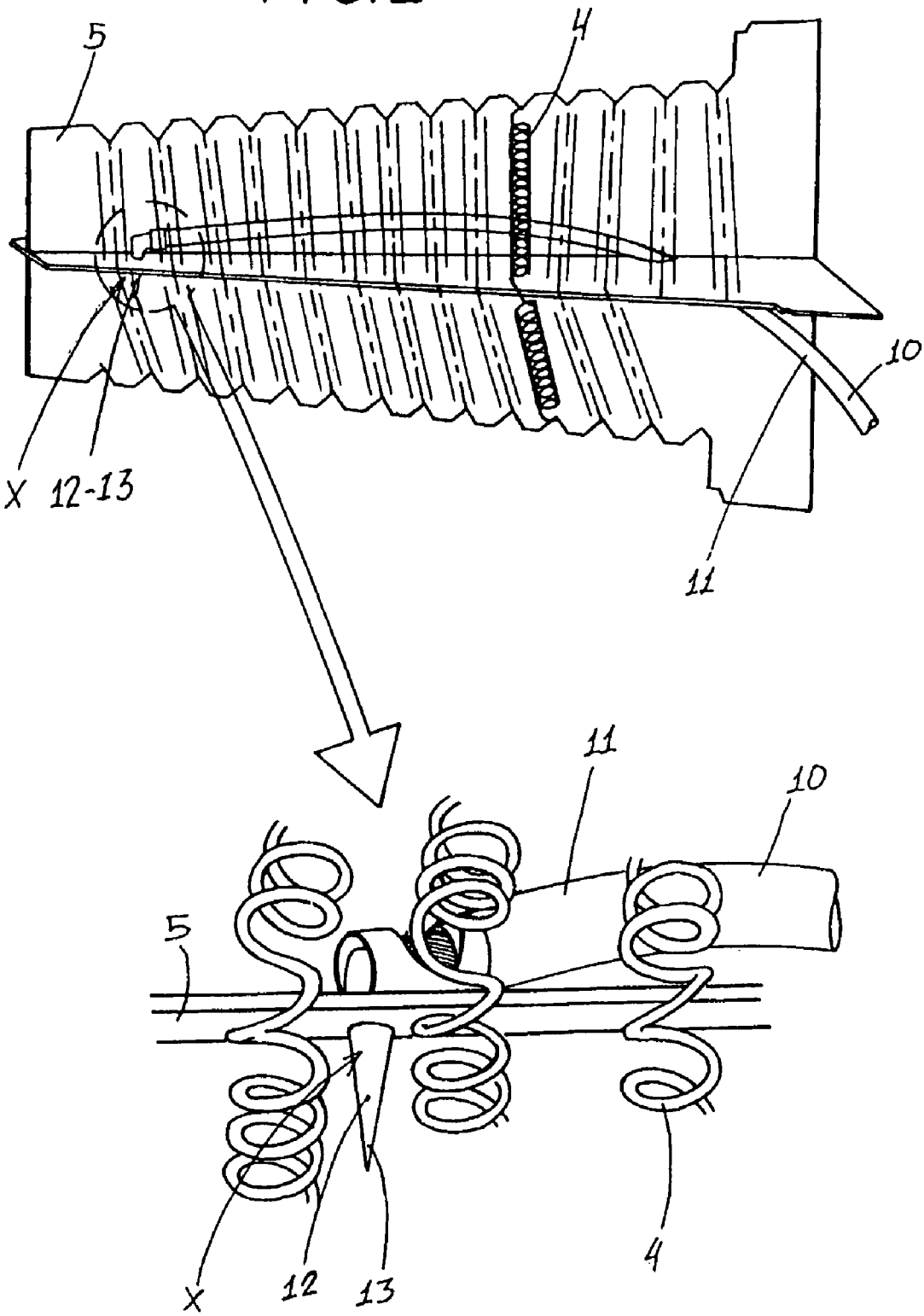
FIG. 2 illustrates a view showing individually the negative ion generating device and the connection thereof with the needle operating as a negative ion emitting pole; said FIG. 2 further counts on an enlarged detail showing specially the negative ion emitting pole.

From the ionizing device 9, at least one cable 10 emerges, which is duly insulated by a sheath 11, said cable 10 passing along the central region of the spacing structure 5, where the electrical resistance 4 is mounted, as illustrated in FIG. 2.

At the end of cable 10 a needle-shaped element 12 is connected, presenting an essentially tapered format, with a sharp-pointed end 13.

Physical configuration of the needle-shaped element 12 can be best noted from the enlarged detail of FIG. 2.

The needle-shaped element 12 configures an active pole X, which is positioned preferably near the previous end of the spacing structure 5, which local coincides with the point with the highest air flow speed crossing the equipment and that therefore presents a higher effectiveness and yield as to improvement of ions produced by device 9.

As it happens with a conventional hair drier, air is admitted by the rear region of housing 1, it being accelerated by rotor 3 and forced to follow by duct defined along said housing 1.

Further in a conventional manner, the air flow reaches the frontal region of the equipment, which presents a slight splay determining the region of a progressive pressure increase and therefore of a higher air flow speed and exactly in that region where the air flow assumes a higher speed, the active pole X is positioned, where the negative ions are generated.

Air drier housing physical configuration as illustrated in FIGS. 1 and 2 should be understood as an example, since the relevant ionizing device can be easily incorporated to other hair drier models.

In the present case, device 9 operates only one active pole X, and such a fact also does not impede the adoption of two or more active poles X, depending on the desired ionization level.

The invention claimed is:

1. "IMPROVED HAIR DRIER" comprising a housing, inside which an electrical engine is mounted, which activates a rotor generating an axial air flow crossing the equipment and contacting a heating element represented by an electrical resistance, duly mounted in a spacing structure; the housing of the relevant hair drier further incorporates a gripping part from which an electrical cable emerges, thereby allowing to connect the hair drier with an electrical network, said gripping part further incorporating keys which control independently both activation of the electrical engine and also activation of the electrical resistance, the hair drier further comprising an ionizing device, which is essentially a high voltage source with a limited current; the ionizing device is connected with the drier by a conventional electrical circuit, it being activated simultaneously with the activation of the electrical engine, or further at the time of the conjoint activation of both electrical engine and the electrical resistance; from the ionizing device, at least one cable emerges, which is duly insulated by a sheath, and at an end of the cable an active pole is mounted.

2. "IMPROVED HAIR DRIER" according to claim 1, wherein the cable passes along a central region of the spacing structure where the electrical resistance is mounted.

3. "IMPROVED HAIR DRIER" according to claim 1, wherein the active pole is configured by a needle-shaped element having an essentially tapered format, with a sharp-pointed end.

4. "IMPROVED HAIR DRIER" according to claim 3, wherein the needle-shaped element configuring the active pole is positioned preferably near a previous end of the spacing structure, which location coincides with a point of highest air flow speed crossing the equipment.

5. "IMPROVED HAIR DRIER" according to claim 1, wherein the relevant drier may incorporate two or more active poles.

6. "IMPROVED HAIR DRIER" according to claim 3, wherein the needle-shaped element configuring the active pole includes a needle-shaped end directly mounted to the cable.

7. "IMPROVED HAIR DRIER" according to claim 1, wherein the heating element includes a relatively vertical portion and a relatively horizontal portion traversing the relatively vertical portion and running substantially perpendicular thereto, the active pole being mounted on the heating element.

* * * * *